United States Patent [19]

Cremona

[11] 4,068,693

[45] Jan. 17, 1978

[54] TRAVERSING DEVICE FOR WOOD SHEARING MACHINE

[76] Inventor: Angelo Cremona, V.le Lombardia, 275, Monza, Italy, 20052

[21] Appl. No.: 686,680

[22] Filed: May 17, 1976

[30] Foreign Application Priority Data

June 26, 1975 Italy ..... 24800/75

[51] Int. Cl.[2] ..... B27L 5/06

[52] U.S. Cl. ..... 144/178; 74/423; 83/556; 144/162 R

[58] Field of Search ..... 74/423, 89.15, 424.8 R, 74/89.13; 83/62, 556, 558, 915.5; 144/209 R, 177, 178, 179, 211, 212, 213, 162 R, 129

[56] References Cited

U.S. PATENT DOCUMENTS

| | | | |
|---|---|---|---|
| 420,886 | 2/1890 | Oncken | 144/213 X |
| 793,306 | 6/1905 | Koss | 144/178 |
| 2,642,902 | 6/1953 | Carey | 144/129 X |

FOREIGN PATENT DOCUMENTS

| | | | |
|---|---|---|---|
| 993,906 | 11/1951 | France | 144/134 |
| 990,039 | 9/1951 | France | 144/134 |

*Primary Examiner*—Othell M. Simpson
*Assistant Examiner*—W. D. Bray
*Attorney, Agent, or Firm*—McGlew and Tuttle

[57] ABSTRACT

A traversing device for the blade-holding unit and the bar-carrying unit of a vertical wood shearing machine, or a wood shearing machine slightly inclined to the vertical, comprising four screws, two of which are placed at the bottom near the slideways, and the other two screws, being placed at the top slightly above the reaction plane of the pressure bar, and a mechanical transmission capable of making the four screws kinematically synchronized with each other.

3 Claims, 3 Drawing Figures

TRAVERSING DEVICE FOR WOOD SHEARING MACHINE

BACKGROUND OF THE INVENTION

In wood shearing machine having the wood supporting table with a supporting surface which is vertical or slightly inclined to the vertical, the traversing device of the whole assembly comprising the blade-holding unit and the bar-carrying unit, usually consisting of a pair of screws connecting the two slides forming the side shoulders of the blade-holding unit and bar-carrying unit, with two rear reaction bodies integral with the bed of the wood shearing machine and placed at its end. The means actuating said screws may vary and do not form part of the present invention.

The function of the screws is to allow the bar-carrying unit and the blade-holding unit to readily come close to the wood stock to be cut before the actual cutting of the wood takes place, and in addition to move the unit forwardly an amount each time, equal to the thickness of the sheets cut as these are obtained.

Every time an operation is undertaken to act upon the blade and the wood stock, or a new wood stock has to be loaded, the screws allow the bar-carrying unit and the blade-holding unit to readily move away towards the rear reaction bodies. Said movements being enabled by rotating the screws in one direction or the other and the screws are connected together by suitable mechanical means so that the slides move forward or rearward accordingly.

Such known solution has a serious drawback due to the fact that the action of the screws is performed on a horizontal plane or a plane slightly inclined to the horizontal, which is relatively distant from the point where the blade and the pressure bar come into contact with the wood stock.

The pressure bar has therefore a pressing force on the wood stock which is in the same direction but is separate from the force imparted by the screws on the blade-holding unit and the bar-carrying unit with the result that torques are generated which tend to rotate the assembly comprising the blade-holding unit and the bar-carrying unit overcoming its force of gravity and causing it to move away from its supporting surface with the obvious result of a faulty and uneven operation.

SUMMARY OF THE INVENTION

According to the invention four screws are provided, instead of the customary two, that is, besides a first pair of screws already known, a second pair of screws are placed slightly above the reaction plane of the pressure bar (that means the plane passing between the blade and the bar), and further, to connect the two pairs of screws with suitable mechanical transmissions thus forming two side parallelograms connected in turn by a horizontal shaft.

It is thus possible to obtain a traversing device for the blade-holding unit and the bar-carrying unit which extends in height to either side of the reaction plane of the pressure bar, to resist any reaction torques generated during traversing of the two units or during operation of the wood shearing machine.

The accompanying drawings show, by way of example only and without limitation, a preferred embodiment of the traversing device according to the present invention of the blade-holding unit and the bar-carrying unit of a wood shearing machine.

THE VIEWS OF THE DRAWINGS

DETAILED DESCRIPTION OF THE PREFERRED EMBODIMENT

Figure 1:
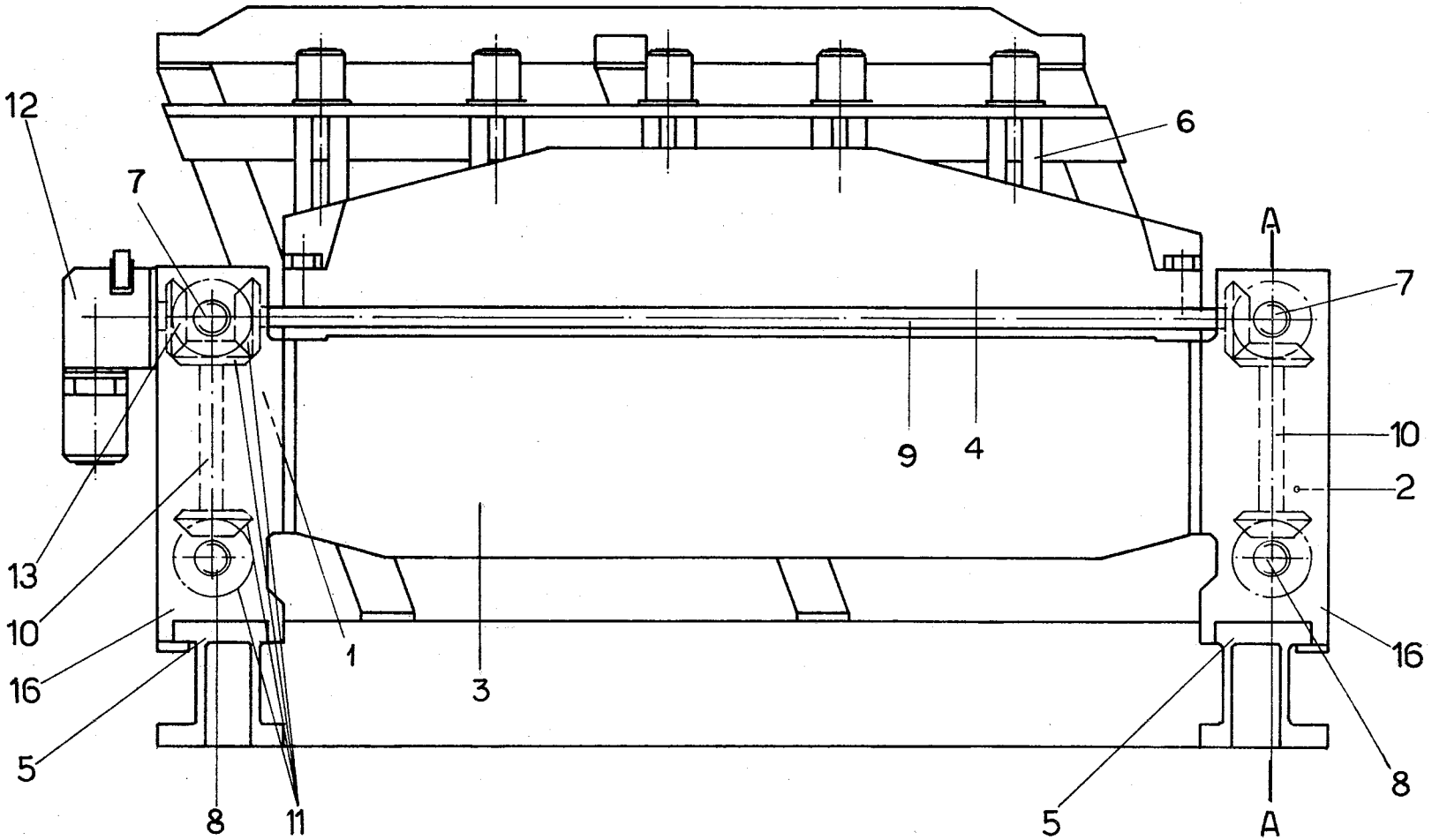
FIG. 1 is a rear view of an almost vertical wood shearing machine provided with the traversing device according to the invention.
Figure 2:
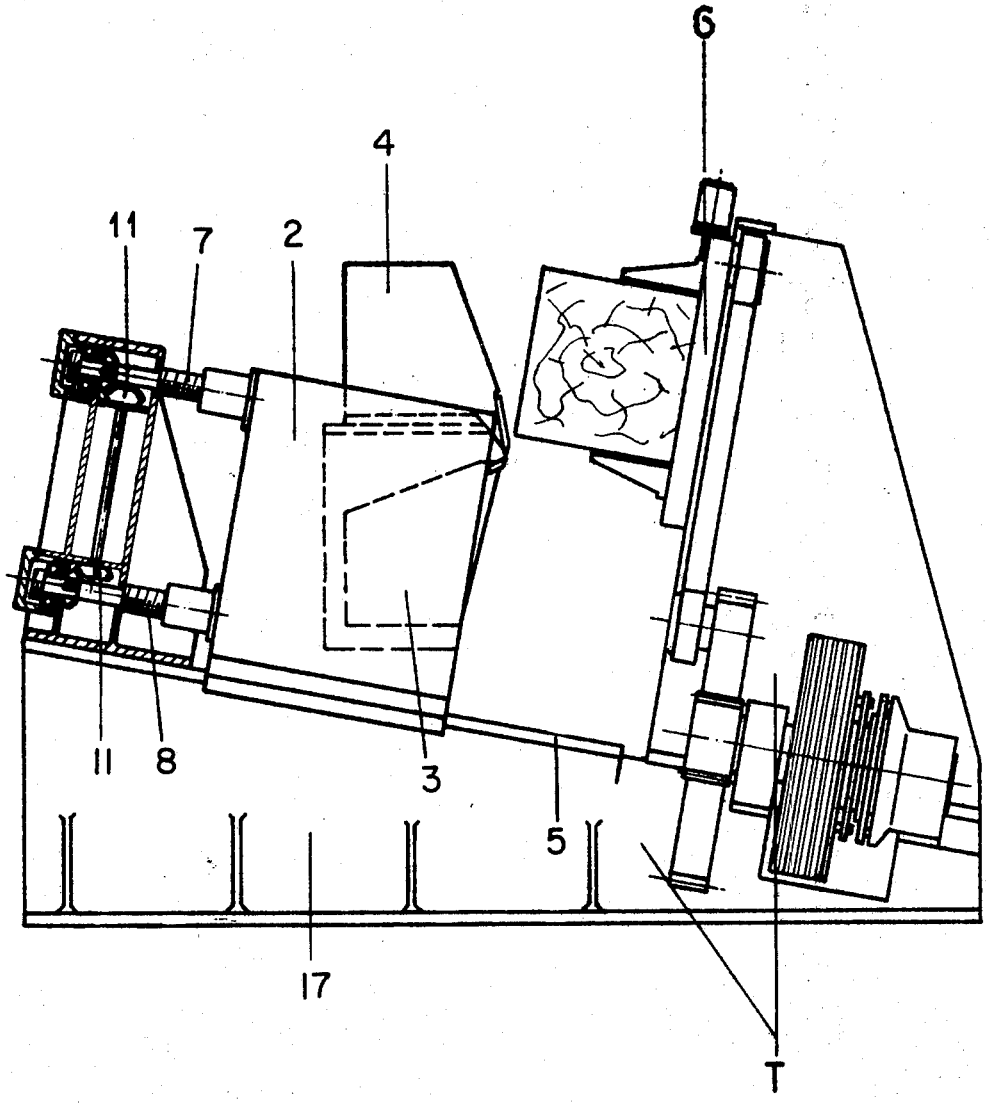
FIG. 2 is a side view of said wood shearing machine, showing the traversing device sectioned along line A—A of FIG. 1.
Figure 3:
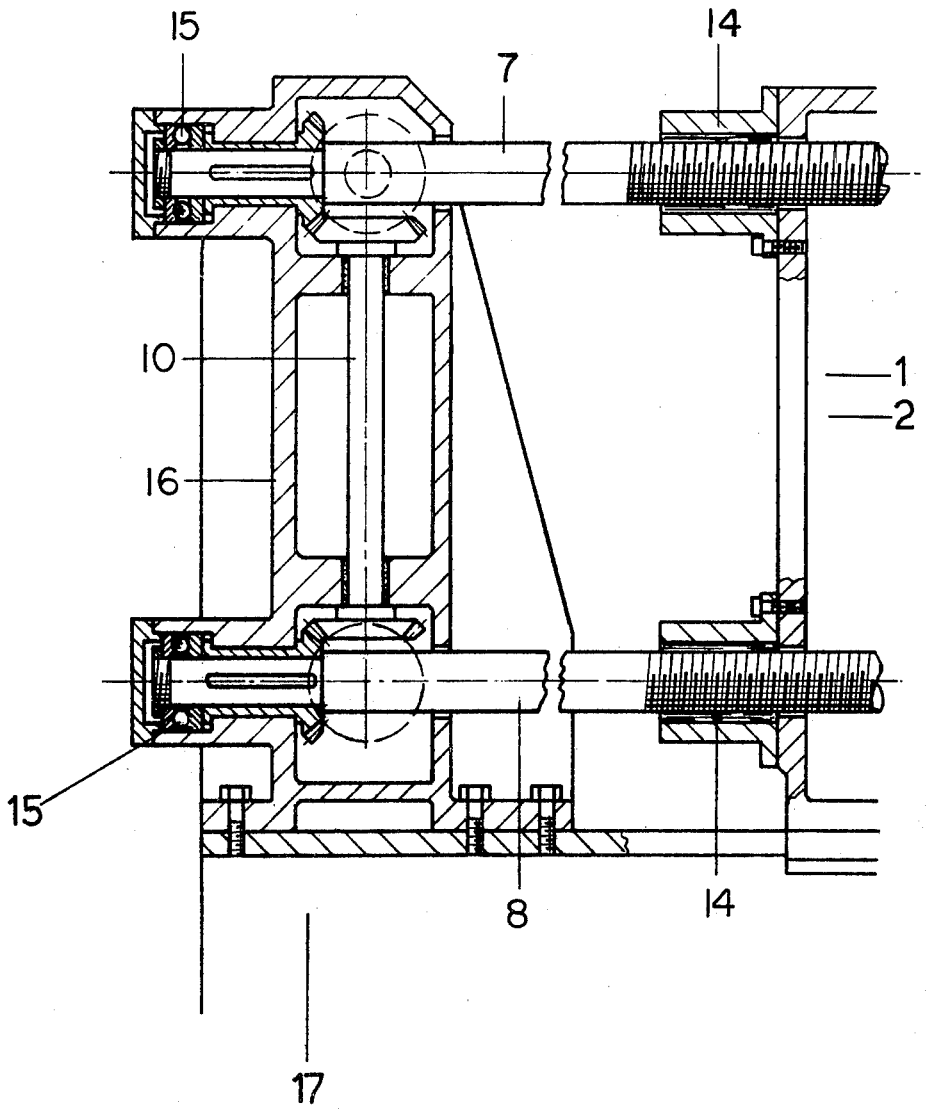
FIG. 3 shows on an enlarged scale and in cross section the traversing device according to the invention.

It has to be borne in mind that in the drawing the wood shearing machine is shown with the wood supporting table slightly inclined to the vertical and with the blade-holding unit placed above the bar-carrying unit. However, the device according to the present invention obviously applies also to perfectly vertical wood shearing machines where the whole assembly of blade-holding unit and bar-carrying unit is subject to traversing motions on a horizontal surface, and this independently of the position of the blade-holding unit with respect to the bar-carrying unit.

As may be seen from the drawing, two side slides, 1, 2 of the wood shearing machine T are rigidly connected to each other by the bar-carrying beam 3 which in turn supports the blade-holding beam 4. The assembly comprising the bodies 1, 2, 3, 4 runs on guides 5 arranged perpendicular to the wood stock support 6.

The traversing device of said assembly is the object of the present invention and comprises two upper screws 7 and two lower screws 8. A horizontal driving shaft 9 connects the upper screws 7 to each other and two vertical shafts 10 each connect an upper screw 7 with a lower screw 8. The four screws, 7, 8 are therefore mechanically in synchronism because they act simultaneously.

Each screw 7, 8 is obviously connected to shafts 9, 10 by suitable means 11 (bevel gears in the drawing). Movement of the screws 7, 8 in one direction or the other, and consequently traversing in both directions of the assembly of bodies 1, 2, 3, 4 also comprising the bar-carrying unit 3 and the blade-holding unit 4, is imparted by means of any type of device 12, connected to the traversing device by means of a gear 13.

The screws 7, 8 are designed to rotate, at one end, in lead screws 14 integral with slides 1, 2 and at the other end in thrust bearings 15 enclosed in the rear reaction bodies 16 which are rigidly connected to the bed 17 of the wood shearing machine T.

The operation of the traversing device according to the invention readily appears from the drawing as well as the advancement in the field with respect to prior art solutions, because it is obvious that the assembly comprising bodies 1, 2, 3, 4 which run on guides 5, is balanced during its motion so as not to generate torques. More specifically the operation of the described assembly is as follows:

To actuate the traversing device the actuating device 12 is actuated to rotate bevel gear 13 in one direction or the other. Bevel gear 13 in turn is coupled to the bevel gears driving the associated vertical shaft 10 and the horizontal driving shaft 9. The rotation of the horizontal driving shaft is in turn imparted to the other pair of screws 7 and 8. The arrangement is such that when the actuating device 12 is operated, the upper pair of screws 7—7 and lower pair of screws 8—8 are synchronized to rotate in one direction or the other accordingly. In doing so the bar carrying unit and blade carrying unit is advanced toward or away from the wood stock support 6.

1. For use in a vertical type wood shearing machine having a bed, a pair of spaced apart guides, a side slide slideably mounted on said guides adapted for movement toward and away from a wood stock to be cut, a bar carrying unit and blade holding unit interconnected between said slides, the improvement of a traversing device for effecting the drive of said slides and connected bar carrying unit and blade carrying unit toward or away from the wood stock comprising a pair of spaced apart upper screws, said pair of screws being operatively connected to a corresponding slide adjacent the upper end of said slides and slightly above the bar carrying unit, a pair of lower screws, each of said lower screws being operatively connected to the lower end of said slides, and means for synchronizing the rotation of said upper and lower pair of screws whereby said bar carrying unit and blade carrying unit can be uniformally advanced toward or away from the wood stock, and reaction body means including thrust bearings therein being connected to said bed, said screws having the other ends thereof journalled in said reaction body means and reacting with said thrust bearing so that said screws resist any torque imparted to said bar carrying unit and blade carrying unit during a cutting operation.

2. The traversing device as defined in claim 1 wherein said synchronizing means comprises a horizontal drive shaft drivingly connected between a pair of said screws, and a vertical shaft interconnecting the drive of the corresponding upper and lower screws of said respective pairs of screws, and an actuating means drivingly connected to one of said vertical shafts and said horizontal shaft.

3. The traversing device as defined in claim 2 wherein the driving connection between said screws and associated drive shafts comprise meshing bevel gears.

* * * * *